US006718699B1

(12) United States Patent
Larson

(10) Patent No.: US 6,718,699 B1
(45) Date of Patent: Apr. 13, 2004

(54) PLACING INADVERTENTLY OMITTED VENTILATION STRIP

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 0 days.

(21) Appl. No.: 10/419,371

(22) Filed: Apr. 21, 2003

(51) Int. Cl.[7] ..... E04B 7/00
(52) U.S. Cl. ..... 52/95; 52/94; 52/96; 52/371
(58) Field of Search ..... 52/94, 95, 96, 52/198, 460, 302.1, 302.3, 302.6, 199, 255, 344, 745.15, 371; 545/365

(56) References Cited

U.S. PATENT DOCUMENTS

| | | | | | |
|---|---|---|---|---|---|
| 3,204,374 | A | * | 9/1965 | Hellekson | 52/94 |
| 4,315,455 | A | | 2/1982 | Shaklee | |
| 4,461,128 | A | * | 7/1984 | Knoebl | 52/94 |
| 5,195,283 | A | * | 3/1993 | MacLeod et al. | 52/95 |
| 5,243,793 | A | * | 9/1993 | MacLeod et al. | 52/95 |
| 5,328,406 | A | * | 7/1994 | Morris et al. | 454/260 |
| 5,718,086 | A | | 2/1998 | Dunn | |
| 5,799,446 | A | * | 9/1998 | Tamlyn | 52/94 |
| 5,881,502 | A | | 3/1999 | Tamlyn | |
| 5,996,289 | A | | 12/1999 | Allaster | |
| 6,145,255 | A | | 11/2000 | Allaster | |

* cited by examiner

*Primary Examiner*—Kimberly Wood

(57) ABSTRACT

An improved ventilation strip for providing a soffit vent on a building. The ventilation strip includes an elongated perforated panel having a substantially planar upper surface and flanges extending laterally there from. A lip is provided on the lower surface of the panel at each edge of the panel running longitudinally thereon. The flanges are of non-uniform cross section and include an upper and a lower surface. The flanges are thickest at the juncture with the panel and thinnest at their outer ends with the lower surface tapering upward from the juncture to the end. Apertures may be provided in the flanges. The ventilation strip is operated by cutting a channel in the soffit of a structure, aligning the strip with the channel, and driving fasteners through the flanges to secure the strip to the soffit. Stucco reinforcement mesh may be secured across the flanges and the soffit and stucco spread thereon to complete the installation. In an alternative embodiment, the upper surface of the flanges may be provided with adhesive and a removable strip. The removable strip can be removed and the flanges pressed against the soffit to secure the ventilations strip to a soffit without the use of fasteners. The tapered edge of the flange enables the edges of the ventilation strip to blend easily with the soffit to create an attractive soffit vent thereon.

19 Claims, 3 Drawing Sheets

PLACING INADVERTENTLY OMITTED VENTILATION STRIP

The present invention relates to ventilation of structures, and more particularly, to a ventilation strip that can be easily and economically installed on the soffit of an existing structure to provide an attractive device for allowing entry of air at the eaves.

BACKGROUND OF THE INVENTION

Residential homes and other buildings typically include an attic above the living area of the structure. It is well known by most homeowners that the attic must be adequately vented to lower summertime cooling costs and to reduce moisture buildup and condensation during the year. Homeowners and contractors typically install upper vents near in the roof for the purpose of allowing heat to flow out of the attic. Since the heat typically rises to the highest area of the attic, these top vents are typically placed near the apex of the roof. These top vents are typically ventilation strips or passive fans that are installed just below the apex of the roof. To achieve proper attic ventilation however, adequate ventilation areas must be placed in a low area of the attic to provide airflow up through the attic. To achieve this airflow, vents are typically installed in the soffit, or under eave area, of the building. Although many prior art soffit ventilation devices have been proposed, most of them are particularly suited to new construction, and do not provide an adequate apparatus for installing ventilation on existing structures.

U.S. Pat. No. 5,881,502 to Tamlyn, for example, describes a ventilation strip for a soffit made of two or more serially arranged boards that, when assembled, form a gap. The gap is closed by a vent strip having a U-shaped receptacle for gripping the soffit board on one side and an L-shaped bracket for latching over the wall veneer on the opposite side. This ventilation strip is particularly suited to veneer finished buildings and can be applied to a newly constructed building as long as a soffit board and veneer strip have been installed in the proper alignment with each other to accept the U-shaped receptacle and L-shaped bracket. In an existing building with the soffit board in place, it would be extremely difficult to cut the soffit board in a manner that it would accept the ventilation strip.

As a second example, U.S. Pat. No. 5,718,086 to Dunn describes a continuous vent in the form of a resilient trough that fits into a bevel in the center of the soffit. This patent describes a method that involves cutting two beveled ends a few inches apart and inserting the resilient apertured vent in the space between the bevels. Although the ventilation device of this patent is very simple, the beveled cuts are much more appropriate for new construction, as the soffit board can be handled and cut on a working surface and then lifted into place under the eaves. It would be very challenging to cut the two beveled edges in an existing soffit, with the work surface overhead and the need to make the beveled cuts exactly parallel to each other. This is especially beyond the capabilities of the average homeowner.

What is needed therefore is an under eave ventilation device and method that can be easily applied to improve the attic ventilation in a structure.

OBJECT OF THE INVENTION

It is therefore an object of the present invention to provide an improved soffit vent for improving the ventilation through an attic. It is also an object to provide a simplified method for installing a soffit vent on a structure for the purpose of improving the ventilation within the attic.

SUMMARY OF THE INVENTION

According to the present invention, there is provided an improved ventilation strip for providing a soffit vent on a building. The ventilation strip includes an elongated perforated panel having a substantially planar upper surface and flanges extending laterally there from. A lip is provided on the lower surface of the panel at each edge of the panel running longitudinally thereon. The flanges are of non-uniform cross section and include an upper and a lower surface. The flanges are thickest at the juncture with the panel and thinnest at their outer ends with the lower surface tapering upward from the juncture to the end.

Apertures may be provided in the flanges. The ventilation strip is operated by cutting a channel in the soffit of a structure, aligning the strip with the channel, and driving fasteners through the flanges to secure the strip to the soffit. Stucco reinforcement mesh may be secured across the flanges and the soffit and stucco spread thereon to complete the installation. In an alternative embodiment, the upper surface of the flanges may be provided with adhesive and a removable strip. The removable strip can be removed and the flanges pressed against the soffit to secure the ventilations strip to a soffit without the use of fasteners. The tapered edge of the flange enables the edges of the ventilation strip to blend easily with the soffit to create an attractive soffit vent thereon.

REFERENCE NUMERALS USED IN THE DETAILED DESCRIPTION AND DRAWINGS

20—ventilation strip, preferred embodiment
22—elongated panel
24—upper surface of panel
26—lower surface of panel
28—first edge of panel
30—second edge of panel
32—perforations
34—lip
36—flange
38—upper surface of flange
40—lower surface of flange
42—first cross-section
44—juncture of flange and panel
46—second cross-section

48—end of flange
50—striations
52—large aperture
54—small aperture
56—channel
58—soffit
60—fastener
62—stucco reinforcement mesh
64—stucco
66—lower surface of soffit
70—ventilation strip, second embodiment
72—adhesive layer
74—protective layer

DETAILED DESCRIPTION

Figure 1:
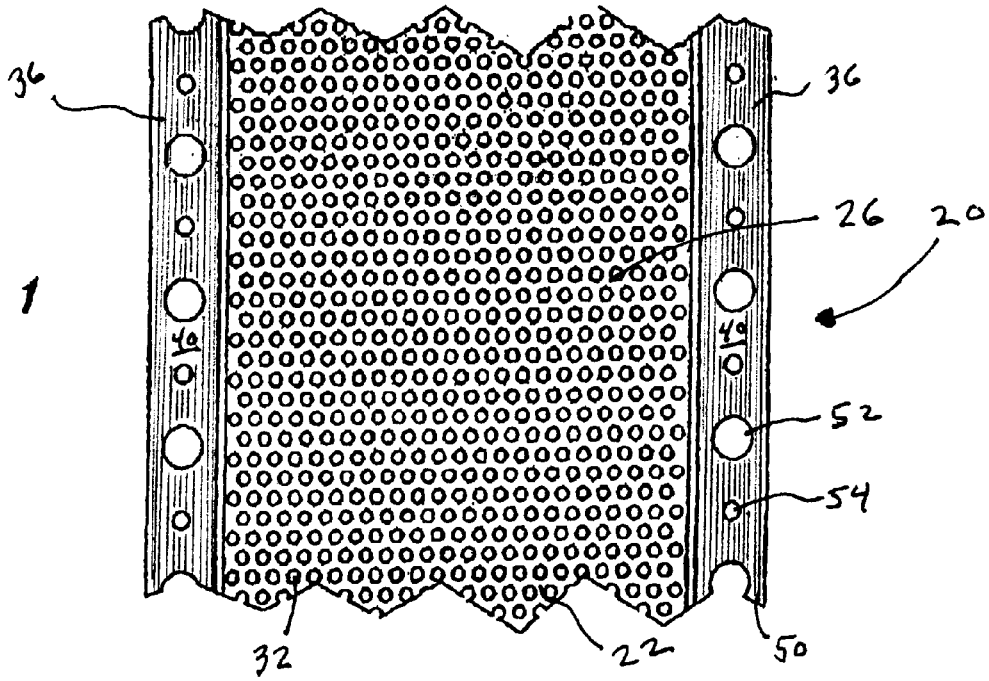
FIG. 1 is a plan view of a preferred embodiment of a ventilation strip according to the present invention.
Figure 2:
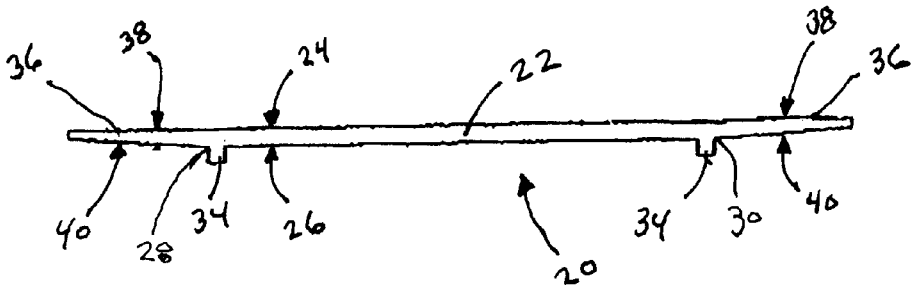
FIG. 2 is a cross-sectional view of the ventilation strip taken along line 2—2 of FIG. 1.

Referring to FIGS. 1 and 2, the preferred embodiment of the ventilation strip 20 of the present invention comprises an elongated panel 22 having a substantially uniform cross-section, an upper 24 surface, a lower surface 26, and two edges 28 and 30. The upper surface 24 is substantially planar. Perforations 32 are provided in the panel 22. A lip 34 is provided at each edge 28, 30. A flange 36 extends laterally from each of the edges 28, 30 and includes an upper 38 and a lower 40 surface.

Figure 5:
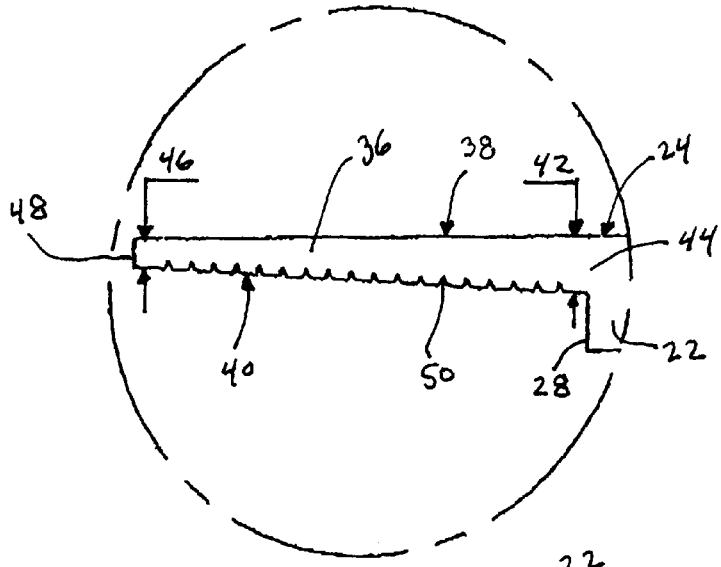
FIG. 5 is a detailed cross-sectional view of a flange on the ventilation strip of FIG. 1.

Referring to FIG. 5, the flanges 36 of the preferred embodiment include a non-uniform cross sectional profile including a first cross-section 42 at the juncture 44 of the flange 36 and the panel 22 and a second cross-section 46 at the end 48 of the flange. The first cross-section 42 is larger than the second cross-section 46 and the upper surface 38 is substantially planar with the upper surface 24 of the panel 22, thereby providing a lower surface 40 that tapers upward from the juncture 44 to the end 48 of each flange 36. The lower surface 40 includes striations 50 running longitudinally along the flange 36.

With reference to FIG. 1, the flanges 36 of the preferred embodiment of the ventilation strip 20 include apertures therein consisting of large apertures 52 and small apertures 54.

Figure 3:
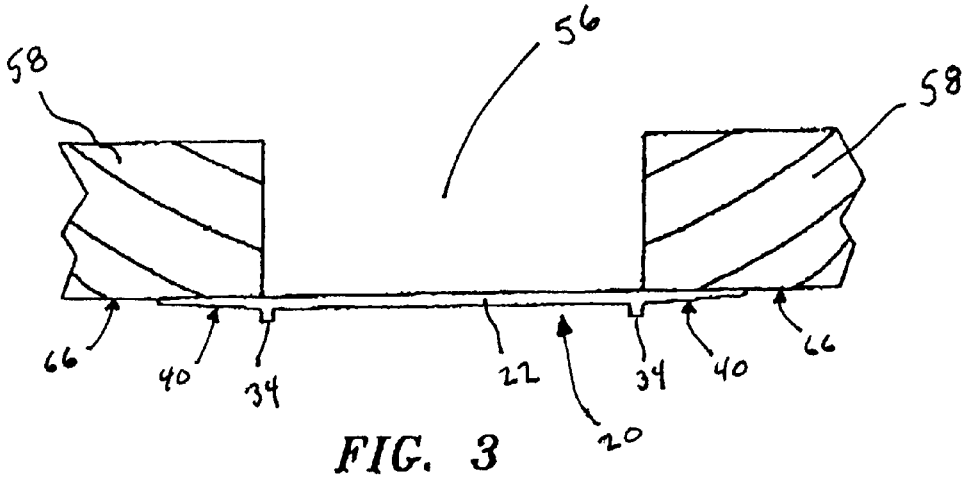
FIG. 3 is a sectional view of the ventilation strip of FIG. 1 installed on the adjacent soffit of a building.
Figure 4:
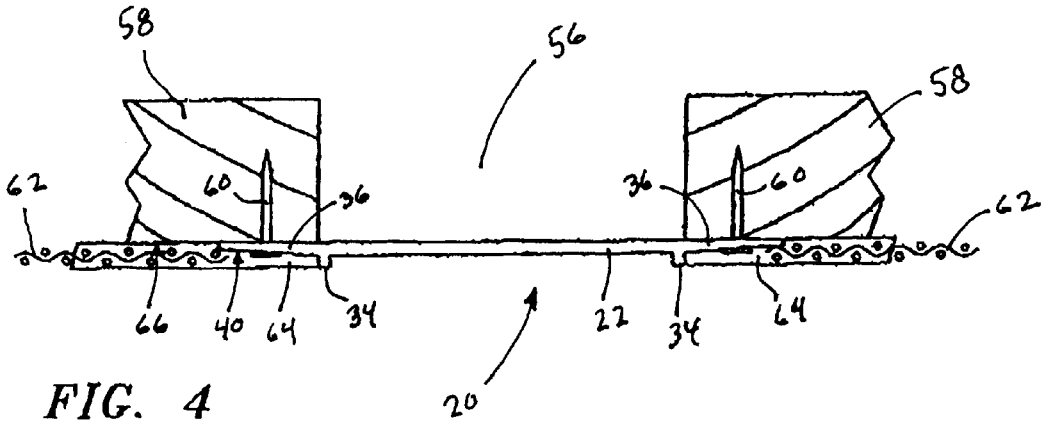
FIG. 4 is a conceptual sectional view of the ventilation strip of FIG. 1 installed on the adjacent soffit of a building with stucco reinforcement mesh and stucco installed thereon.
Figure 6:
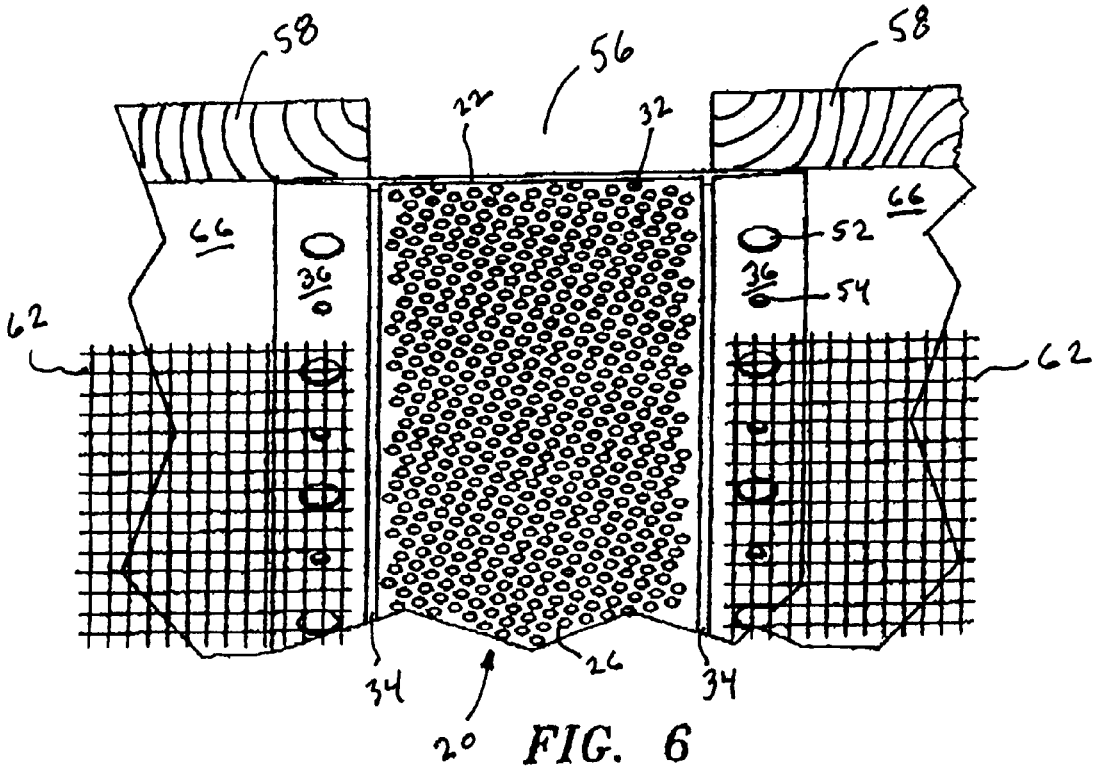
FIG. 6 is a perspective view of the ventilation strip of FIG. 1 installed on the soffit of a building with stucco reinforcement mesh installed thereon.

To explain the operation of the preferred embodiment of the ventilation strip 20, reference should be made to FIGS. 3, 4, and 6. The ventilation strip 20 of the present invention is used to provide a soffit vent in the soffit, or horizontal surface under an eave of an overhanging roof of a building. Soffit vents are typically used to provide entry air to establish an upward flow of air into an attic to carry the stagnant air therein out of one or more vents or passive fans in the upper portions of an attic. As shown in FIG. 3, to install the ventilation strip 20 of the present invention, a channel 56 is first cut in the soffit 58. The channel 56 is cut longitudinally in the soffit 58 so that the channel parallels the exterior wall of the house (not shown). The width of the channel 56 is cut approximately to match the distance between the lips 34 of the flanges. The elongated panel 22 of the ventilation strip 20 is then lifted in place and centered over the channel 56 as shown. Nails 60, as shown in FIG. 4, or other suitable fasteners are then driven through the flanges 36. It should be emphasized at this point that the lips 34 project from the lower surface 26 of the panel 22 a distance long enough to accommodate the thickness of stucco reinforcement mesh 62 and stucco 64. Two strips of stucco reinforcement mesh 62 are typically cut to shape to span the lower surface 66 of the soffit 58 and the flanges 36 and typically includes an adhesive on one side allowing it to be pressed against the lower surface 66 of the soffit. Stucco 64 is then troweled over the mesh 62 and the overlying surfaces to complete the installation of the ventilation strip 20. The large apertures 52 in the flanges 36 and the striations 50 in the lower surface 40 of the flanges is to provide a convoluted and rough surface structure to anchor stucco, grout, or similar surface coverings when they are applied over the flanges 36.

Figure 7:
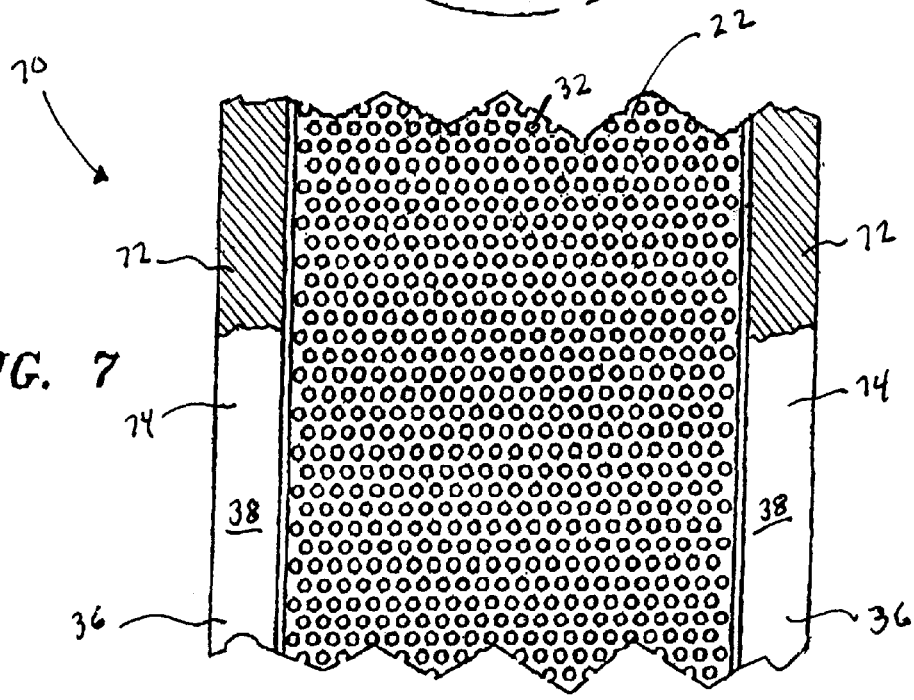
FIG. 7 is a plan view of a second embodiment of the ventilation strip of the present invention.

A second embodiment of the ventilation strip 70 according to the present invention, for use on a soffit not requiring stucco or other wall finishing spreads, is depicted in FIG. 7. This embodiment of the ventilation strip 70 is substantially similar to the preferred embodiment but without any apertures in the flanges 36. This ventilation strip 70 is intended for use on an existing soffit that is typically painted wood or other substrate, with no stucco or other facing material applied. The upper surface 38 of the flange 36 of ventilation strip 70 includes an adhesive layer 72 thereon and a removable protective layer 74 on top of the adhesive layer.

Figure 8:
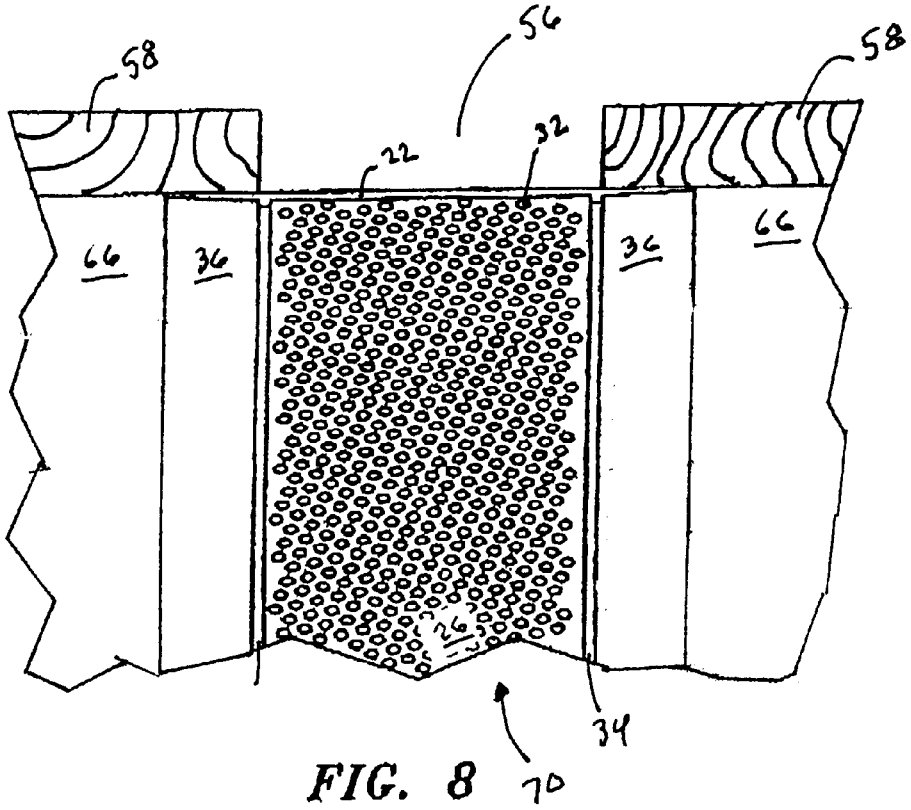
FIG. 8 is a perspective view of the ventilation strip of FIG. 7 installed on the soffit of a building.

Referring to FIGS. 7 and 8, the second embodiment of the ventilation strip 70 is placed in operation by cutting a channel 56 in the soffit 58. The channel 56 is approximately as wide as the panel 22. The protective layer 74 is removed from the upper surface 38 of the flanges 36 thereby exposing the adhesive layer 74 underneath. The ventilation strip 70 is then aligned with the channel 56 such that the upper surface 38 of the flanges 36 are overlapping the lower surfaces 66 of the soffit 58, and then pressed upwards to secure the flanges 36 against the lower surface 66 of the soffit 58.

With reference to FIG. 1, the panel 22 can be produced in various widths to provide a vent area suitable to the particular venting application desired. A wider panel will, assuming it is perforated with the same size and pattern of holes therein, provide a larger airflow per linear foot of vent 20 than will a narrower vent of the same perforation pattern. Larger roof overhangs can, naturally, accommodate larger ventilation strips 20. Typical panel widths, or vent areas, are 1.75", 2.625", 3.0", 4.0", or 6.0".

Referring to FIGS. 1 and 4, the flanges 36 of the ventilation strip 20 of the present invention preferably extend between 0.375 and 1.5 inches from the outer edges 28, 30 of the panel 22. Although it can be used on newly constructed houses, the ventilation strip 20 is designed for easy application to existing structures. The flanges 36 therefore are wide enough to accommodate and hide any uneven cuts made by the homeowner or contractor while cutting the channel 56 in the soffit 58.

The ventilation strip of the present invention is preferably constructed of plastic and typically produced by an extruding process. The preferred materials of construction are polyvinyl chloride, polypropylene, or acrylonitrile butadiene styrene. The panel 22 is preferably between 0.03 and 0.07 inch in thickness. The cross-section of the flanges at the juncture 44 of the flange 36 and panel 22 is preferably between 0.02 and 0.06 inch tapering to a cross-section at the end 48 of the flange 36 preferably between 0.005 and 0.025 inch. The striations 50 in the lower surface 40 of the flanges 36 are preferably 0.003 and 0.008 inch deep in the lower surface 40. The perforations 32 in the panel 22 are preferably circular apertures having a diameter between 0.005 and 1.5 inches. The lips 34 preferably extend between 0.003 and 0.013 inch from the lower surface 26 of the panel 22. The lips 34 extend at least 0.003 inch from the lower surface to enable later application of an adequate layer of stucco 64 to properly cover the extending flanges 36. The upper limit of extension of the lips 34 is preferred to be no more than 0.013 inch to minimize the amount of stucco 64 required and to also enable easy trimming of the ventilation strip to desired lengths and shapes to accommodate corners and bends. A ventilation strip according to the present invention can be easily cut using tin snips or similar tools.

Referring to FIG. 1, the large apertures 52 in the flanges 36 are preferably between 0.03 and 0.05 inch in diameter and the small apertures 54 are preferably between 0.10 and 0.20 inch in diameter. The large apertures 52 are provided in the flanges 36 to allow open areas therein to promote good surface bonding of the stucco that later is applied over the flanges. The small apertures 54 are provided to create open areas to accommodate the shank of the fasteners therein but also provide surrounding area to accommodate the head of the fasteners thereon.

As shown in FIGS. 4 and 5, the flanges 36 are thicker at the juncture 44 with the panel 22 and thinner at their ends 48 with the lower surface 40 of the flange 36 tapering upwards. In the first embodiment, this tapering of the flange 36 allows for thicker application of stucco 64 the end 48 of the flange than at the juncture 44. This ensures that there is adequate stucco 64 to cover the end 48 of the flange 36 and thereby prevent an unattractive line from showing in this area after the stucco application is completed. In the second embodiment, as shown in FIG. 8, the tapered end 48 of the flange 36 creates a very small vertical edge at the end of the flange, thereby creating an attractive edge where the flange 36 joins the soffit 58 and leading to little or no shadow in different lighting conditions. For those situations in which the color of the ventilation strip 70 matches the color of the lower surface 66 of the soffit 58, such as when both are white, painting over the soffit and strip are not typically required. This permits easy modification of existing structures in which under eave ventilation was originally inadvertently omitted. The various plastics mentioned herein could of course be modified with pigments to enable production of the present invention in a wide range of colors.

As will be apparent to the skilled artisan, a number of variations and modifications can be made to the structure described above without departing from the spirit and scope of the present invention. All such modifications and variations are clearly contemplated as being within the scope of the appended claims.

What is claimed is:

1. A ventilation strip comprising:

an elongated panel having an upper surface, a lower surface, a substantially uniform cross-sectional profile, and two edges;

said elongated panel including a substantially planar upper surface;

perforations in said panel;

a lip at each of said edges;

a flange extending laterally from each of said edges;

said flanges having an upper and lower surface; and said flanges of non-uniform cross-sectional tapering profile.

2. The ventilation strip of claim 1 wherein said cross-sectional profile of said flanges includes a first cross-section at the juncture of said flange with said edge; and a second cross-section at the end of said flange;

wherein said first cross-section is larger than said second cross-section.

3. The ventilation strip of claim 2 wherein said upper surface of said flange is substantially planar with the upper surface of said panel and said lower surface of said flange tapers upward from said juncture to said end.

4. The ventilation strip of claim 3 wherein said cross-sectional profile of said panel is between 0.03 and 0.07 inch;

said first cross-section of said flange is between 0.02 and 0.06 inch;

and said second cross-section of said flange is between 0.005 and 0.025 inch.

5. The ventilation strip of claim 4 wherein said lower surface of said flanges include striations therein.

6. The ventilation strip of claim 5 wherein said striations run longitudinally along said lower surface of said flanges.

7. The ventilation strip of claim 6 wherein said striations have a depth of between 0.003 and 0.008 inch in said lower surface.

8. The ventilation strip of claim 1 wherein said flange extends laterally from each of said edges between 0.375 and 1.5 inches.

9. The ventilation strip of claim 1 wherein said perforations are circular apertures having a diameter between 0.005 and 0.015 inch.

10. The ventilation strip of claim 5 wherein said flanges further include apertures therein.

11. The ventilation strip of claim 10 wherein said apertures include large apertures and small apertures.

12. The ventilation strip of claim 11 wherein said large apertures are between 0.03 and 0.05 inch in diameter and said small apertures are between 0.10 and 0.20 inch in diameter.

13. The ventilation strip of claim 1 wherein said strip is constructed of plastic.

14. The ventilation strip of claim 13 wherein said strip is constructed of polyvinyl chloride, polypropylene, or acrylonitrile butadiene styrene.

15. The ventilation strip of claim 1 wherein said lip extends between 0.003 and 0.013 inch from said lower surface of said panel.

16. A method of creating a soffit vent under a eave of an overhanging roof of a building comprising the steps of:

providing a ventilation strip including an elongated panel having an upper surface, a lower surface, a substantially uniform cross-sectional profile, and two edges;

providing a substantially planar upper surface on said panel;

providing perforations in said panel;

providing a lip at each of said edges;

providing a flange of non-uniform cross-sectional tapering profile extending laterally from each of said edges;

cutting a longitudinal channel in the soffit of the building with the edges of said channel a distance apart substantially equal to the width of said panel;

placing said ventilation strip against said soffit;

aligning said panel under said channel; and driving a suitable number of fasteners through said flanges to secure said ventilation strip to said soffit.

17. The method of claim 16 further including the steps of:

securing stucco reinforcement mesh across the lower surface of one of said flanges and the adjacent soffit;

securing stucco reinforcement mesh across the lower surface of the other of said flanges and the adjacent soffit;

spreading stucco across said stucco reinforcement mesh and said soffit until said stucco is level with each of said lips.

18. A method of creating a soffit vent under the eave of an overhanging roof of a building comprising the steps of:

providing a ventilation strip including an elongated panel having an upper surface, a lower surface, a substantially uniform cross-sectional profile, and two edges;

providing a substantially planar upper surface on said panel;

providing perforations in said panel;

providing a lip at each of said edges;

providing a flange of non-uniform cross-sectional tapering profile extending laterally from each of said edges, said flange including an upper and a lower surface, said flange including a first end at the juncture with said panel and a second end opposite said juncture, said flange thicker at said juncture and thinner at said end;

providing an adhesive layer on the upper surface of said flange;

providing a removable protective layer on said adhesive layer;

cutting a longitudinal channel in the soffit of the building with the edges of said channel a distance apart substantially equal to the width of said panel;

removing said removable protective layer from said adhesive layer;

aligning said panel under said channel and said adhesive layers under said soffit at each side of said channel; and pressing said upper surface of said flanges against said soffit to secure said ventilation strip to said soffit wherein said upper surface of said flanges are flush with the lower surface of said soffit and said ends of said flanges extend a minimal distance from said lower surface of said soffit.

19. A ventilation strip comprising:

an elongated panel having an upper surface, a lower surface, a substantially uniform cross-sectional profile, and two edges;

said elongated panel including a substantially planar upper surface;

perforations in said panel;

a lip at each of said edges;

a flange extending laterally from each of said edges;

said flanges having an upper and lower surface;

said flanges of non-uniform cross-sectional tapering profile;

an adhesive layer on said upper surface of said flange; and a removable layer on said adhesive layer.

* * * * *